United States Patent [19]

Gray

[11] 4,367,638

[45] Jan. 11, 1983

[54] REVERSIBLE COMPRESSOR HEAT PUMP

[75] Inventor: David A. Gray, Tyler, Tex.

[73] Assignee: General Electric Company, Louisville, Ky.

[21] Appl. No.: 164,666

[22] Filed: Jun. 30, 1980

[51] Int. Cl.[3] ..... F25B 13/00; F04C 18/00; F04C 29/08

[52] U.S. Cl. ..... 62/324.6; 62/508; 418/15; 418/63

[58] Field of Search ..... 62/324.1, 324.6, 508; 418/15, 63–67, 248, 249; 417/442

[56] References Cited

U.S. PATENT DOCUMENTS

| | | | |
|---|---|---|---|
| 1,982,264 | 11/1934 | Naab | 417/315 |
| 2,277,270 | 3/1942 | Schmitter et al. | 418/32 |
| 2,306,632 | 12/1942 | McCormack | 62/508 |
| 2,342,174 | 2/1944 | Wolfert | 62/160 |
| 2,343,514 | 3/1944 | McCormack | 62/160 |
| 2,778,316 | 1/1957 | Haight et al. | 418/32 |
| 2,801,528 | 8/1957 | Parcaro | 62/278 |
| 2,844,945 | 7/1958 | Muffly | 62/160 |
| 2,976,698 | 3/1961 | Muffly | 62/160 |
| 3,330,215 | 7/1967 | Yamane | 418/227 |
| 3,723,024 | 3/1973 | Sawai et al. | 418/159 |
| 3,891,358 | 6/1975 | Ladusaw | 418/63 |
| 3,985,473 | 10/1976 | King et al. | 418/248 |

*Primary Examiner*—John J. Vrablik

*Attorney, Agent, or Firm*—Frank P. Giacalone; Radford M. Reams

[57] ABSTRACT

A reversible hermetically sealed rotary compressor for use in a refrigeration system comprising a compressor cylinder, a rotor eccentrically rotatable in the cylinder and a vane dividing the cylinder between high and low pressure sides relative to direction of rotation of the rotor. Suction and discharge ports provided for each direction of rotation are automatically switched by changing the direction of rotation of the rotor.

8 Claims, 4 Drawing Figures

REVERSIBLE COMPRESSOR HEAT PUMP

BACKGROUND OF THE INVENTION

This invention relates to a reversible rotary compressor adapted for use in refrigeration systems, and more particularly as applied to heat-pump type air conditioners wherein the operation of the refrigeration system can automatically be switched from cooling operation to heating operation or vice versa, without using a directional control valve which have been employed in conventional heat pump-type air conditioners for changing the direction of flow of a refrigerant passing through a refrigerant circuit.

Conventional compressors for refrigeration systems are generally classified into a reciprocating and a rotary type. The reciprocating type compressor has the disadvantage that the flowing direction of refrigerant cannot be reversed. The rotary type compressors generally have a suction port only on the suction side and a discharge port only on the discharge side with respect to the pressure transition point. With the suction and discharge directions so fixed, practical use of such a compressor as a reversible compressor is not possible.

One form of reversible rotary compressor is disclosed in U.S. Pat. No. 2,342,174 wherein a mechanically operated reversing valve is arranged in the casing. The reversing valve includes an external member that is mechanically engaged by a member mounted on the motor compressor shaft to shift the external valve member when direction of the shaft is reversed. U.S. Pat. Nos. 2,844,945 and 2,976,698 disclose another form of reversible rotary compressor employing various valves and refrigerating and air conditioning system configurations and more particularly for defrosting freezer evaporators of two temperature system. In still another prior art U.S. Pat. No. 3,723,024, a reversible rotary compressor is disclosed wherein a movable suction mechanism is provided that is rotated through a predetermined angle so that the suction opening may be shifted to one side or the other of the pressure transition point.

SUMMARY OF THE INVENTION

The present invention provides a reversible hermetically sealed electrically motor driven rotary refrigerant compressor arranged in a casing containing high pressure refrigerant and a first and second opening. The compressor unit positioned in the casing includes a cylinder having an annular chamber, spaced upper and lower end walls enclosing the annular chamber. A rotor is eccentrically rotatable within the chamber with its peripheral surface arranged to move progressively into sealing relationship with successive portions of the chamber. The reversible electric motor shaft extends into the cylinder to drive the rotor. A blade is positioned in a slot formed in the cylinder and is biased against the rotor to provide the pressure transition point that divides the chamber into interchangeable high and low pressure sides.

A first gas suction port communicating with one side of the chamber and a first gas discharge port communicating with the other side of the chamber are located in the cylinder. A second gas suction port communicating with the other side of the chamber, and a second gas discharge port communicating with the one side of the chamber are located in the cylinder. The first suction port is connected to one of the casing openings with the first discharge port connected to the other casing opening when the rotor is rotating in one direction, and the second suction port is connected to the other casing opening with the second discharge port connected to the one casing opening when the rotor is rotating in the other direction.

An object of the present invention is to provide a reversible rotary compressor for use in refrigeration systems which is designed to that the directional flow of the discharge and suction gas is switched automatically by the rotation of the rotor.

DESCRIPTION OF THE PREFERRED EMBODIMENT

Figure 1:
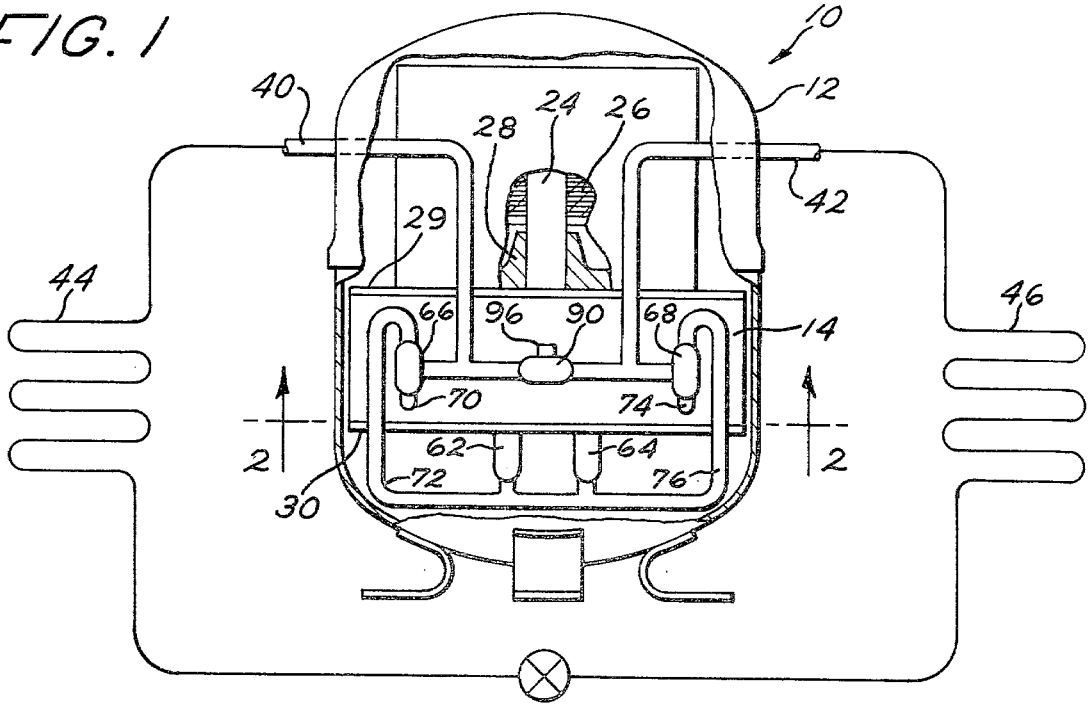
FIG. 1 is a somewhat schematic view of a heat pump including the reversible rotary compressor of the present invention.
Figure 2:
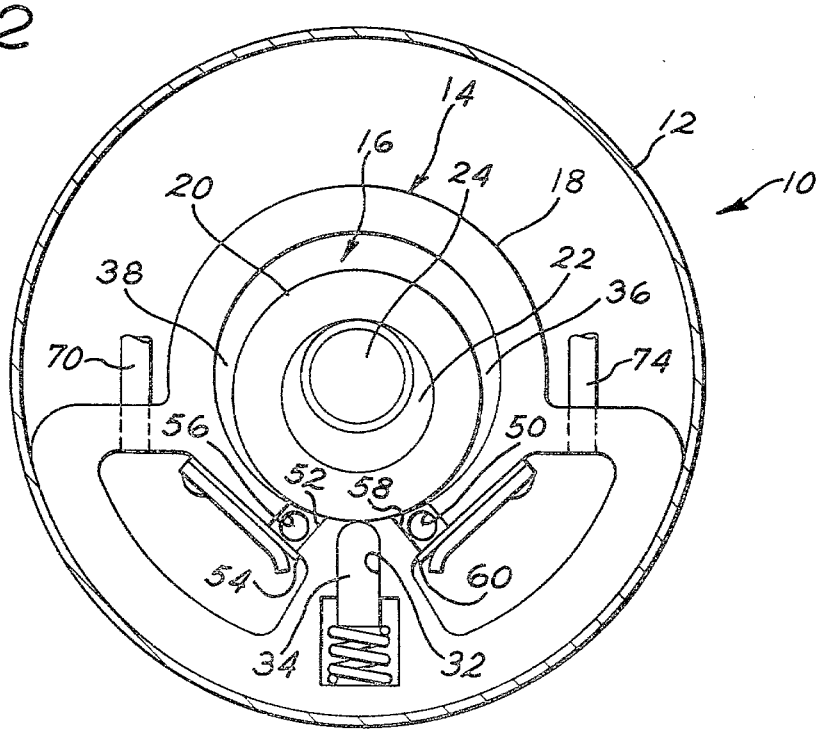
FIG. 2 is a plan view of the compressor taken generally along line 2—2 of FIG. 1.

Referring to FIGS. 1 and 2, there is shown a hermetic compressor 10 including a hermetic casing 12 in which there is disposed a refrigerant compressor unit 14 having an annular chamber or compressor chamber 16 defined within a cylinder or housing 18. Disposed for rotation within the chamber 16 is a rotor 20 which is driven by an eccentric 22 formed as an integral part of the drive shaft 24 extending downwardly from the motor 26. The motor 26 as applied in the present invention is of the electrically reversible type and is merely intended to represent a conventional motor of the type which may be caused to operate in either direction. A bearing formed in the supporting main frame 28 supports the shaft 24 above the eccentric 22 for rotation by the motor 26. The annular compressor chamber 16 is enclosed by upper end wall 29 and an opposite or lower end wall 30. The lower wall 30 also supports the lower end of the shaft 24.

As may best be seen in FIG. 2, the cylinder 18 is provided with a radial slot 32 having slidably disposed therein a blade or vane 34 which is biased into engagement with the peripheral surface of the rotor 20 forming a pressure transition point dividing the chamber 16 into interchangeable high and low pressure sides designated 36 and 38 depending, as will be explained later in detail, on the direction of rotation of the rotor 20.

As may be seen in FIG. 1, the hermetic compressor 10 is adapted to be connected into a refrigeration system including indoor heat exchanger or coil 44 and an outdoor heat exchanger or coil 46, and an expansion means 48 for the purpose of expanding refrigerant from condensing pressure to evaporator pressure. This expansion device operates during both cooling and heating cycles to maintain a predetermined pressure differential between the evaporator and the condenser regardless of the direction of refrigerant flow.

In an air conditioning unit of this type, the indoor coil 44 is arranged for heating or cooling air from an enclosure being conditioned, while the outdoor coil 46 is arranged for either rejecting heat to or extracting heat from the outside atmosphere. By the present invention, the compressor is selectively reversible to direct discharge gas into either one of the lines or conduits 40 and 42 while receiving low pressure gas from the other line, thereby making this system reversible for either heating or cooling an enclosure. Thus, if it is desirable to set this system on the heating cycle, compressor discharge gas flows through line 40 which carries the hot discharge gas to the indoor coil 44. This coil then acts as a condenser to give up its heat to the enclosure while the suction gas flows into line 42 from the outdoor coil 46 functioning as the evaporator. If it is desired to set the system for cooling the enclosure, compressor suction gas flows through line 40 which carries the cold suction gas from the indoor coil 44 back to the compressor. This coil then acts as an evaporator, while the discharge gas is carried through line 42 to the outdoor coil 46 which is now functioning as the system condenser.

By the present invention, means are provided in the hermetic compressor for automatically directing the flow of refrigerant discharge and suction gas between lines 40 and 42 by changing the direction of rotation of motor 26.

Connecting with side 36 of chamber 16 is an inlet or suction port 50 through which suction gases may be drawn into the chamber 16 during rotation of the rotor in the counter-clockwise direction. Located on the other side of the blade 34 or side 38 of the chamber 16 is an outlet or discharge port 52 through which the compressed gases are discharged from the compressor during counter-clockwise rotation of the rotor 20. A suitable valve 54 is provided in the discharge passage for assuring proper compression of the gases issuing through the discharge port 52 and for preventing reverse flow of discharge gases back into the compression chamber.

Connecting with side 38 of chamber 16 is an inlet or suction port 56 through which suction gases may be drawn into the chamber 16 during rotation of the rotor in the clockwise direction. Located on the other side of the blade 34 or side 36 of the chamber 16 is an outlet or discharge port 58 through which the compressed gases are discharged from the compressor during clockwise rotation of the rotor 26. A suitable valve 60 is provided in the discharge for assuring proper compression of the gases issuing through the discharge port 58 and for preventing reverse flow of discharge gases back into the compression chamber.

It is normal practice in rotary compressors, in order to obtain the maximum possible displacement to position the suction and discharge ports as closely as possible to the opposite sides of the blade 34. Means are provided by the present inventor to permit suction gas to enter the chamber through the suction port on one side of the blade 34 in one direction of rotation while at the same time preventing discharge gas from being discharged through the suction port on the other side of the blade. To this end, check valves 62 and 64 (FIG. 3 and 4) are arranged relative to the suction ports 56 and 50 respectively.

In the present embodiment shown, the valves 62 and 64 are gravity biased ball check valves. It should be noted that other type valves may be employed. The valve 62 has its upper open end 61 connected to suction port 56 with the ball valve member 59 normally seated at the bottom end 75. The valve 64 has its upper end 63 connected to suction port 50 with the ball valve member 65 normally seated on the bottom end 81. In the suction flow direction toward the ports 56 and 50, the valves open under influence of suction gas allowing suction gas to be drawn into the low pressure side of the blade 34 as will be explained later in detail. Means are provided for alternating suction and discharge gas flow between the lines 40 and 42. To this end, a gravity biased ball check valve 66 is interposed between the conduit 40 and check valves 62 and 54 while a gravity biased ball check valve 68 is interposed between the conduit 42 and check valves 64 and 60. It should be noted that like valves 62 and 74, other type valves may be employed. A high pressure conduit 70 is connected between the normally closed end 71 of valve 66 and the discharge port 52 on side 38 of chamber 16. A low pressure conduit 72 is connected between the normally open ends 73 of valve 66 and the normally closed end 75 of suction valve 62. A high pressure conduit 74 is connected between the normally closed end 77 of valve 68 and the discharge port 58 on side 36 of chamber 16. A low pressure conduit 76 is connected between the normally open end 79 of valve 68 and the normally closed end 81 of suction valve 64. The ends 73 and 79 are interconnected through conduits 72 and 76 by a conduit 80. The ball valve member 82 of valve 66 is normally seated on opening 71 while the ball valve member 84 is normally seated on opening 77.

Figure 3:
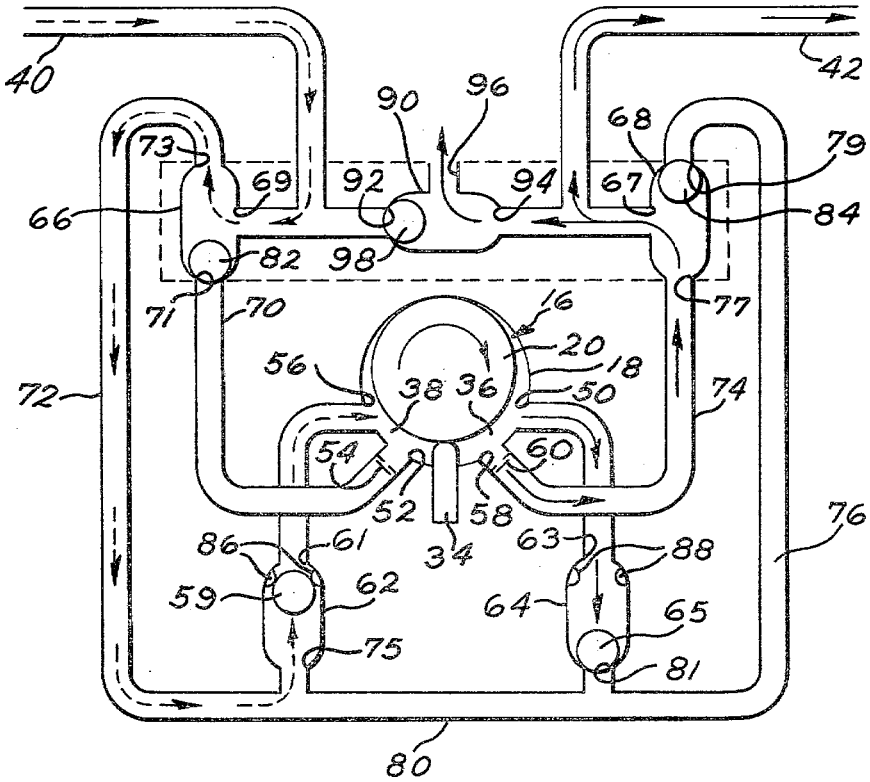
FIG. 3 is a schematic view of the heat pump system showing refrigerant flow in one direction.

In operation in cooling cycle, the rotor 20 is driven by motor 26 in the clockwise direction as shown in FIG. 3. Suction gas flow as indicated by the broken line arrow entering conduit 40 from indoor heat exchanger 44 functioning as the evaporator. Since the valve 66 is in its normal position with end 71 closed by ball valve 82, the suction gas flows through the open end 73 and conduit 72. Suction pressure flowing through line 72 lifts ball valve 59 and opens the gravity biased check valve 62. Means are provided in the form of projection 86 in the present embodiment to insure that suction gas enters side 38 of chamber 16. Rotation of the rotor in the clockwise direction compresses the gas in side 36 of chamber 16 and discharges the now high pressure gas through port 58. The discharge pressure being sufficient to open valve 60 and to maintain valve 64 in its closed position against action of low pressure suction gas present in line 80. Discharge gas flow is indicated by the solid line arrow and now flows through conduit 74 with enough pressure to force the ball valve member 84 of valve 68 off the normally closed end 77 and high pressure gas flows through unvalved opening 67 of valve 68 and through line 42 to the outdoor coil 46 functioning as the system condenser. At the same time, high pressure gas closes off end 79 of valve 68 as shown thereby preventing flow into low pressure line 76.

Figure 4:
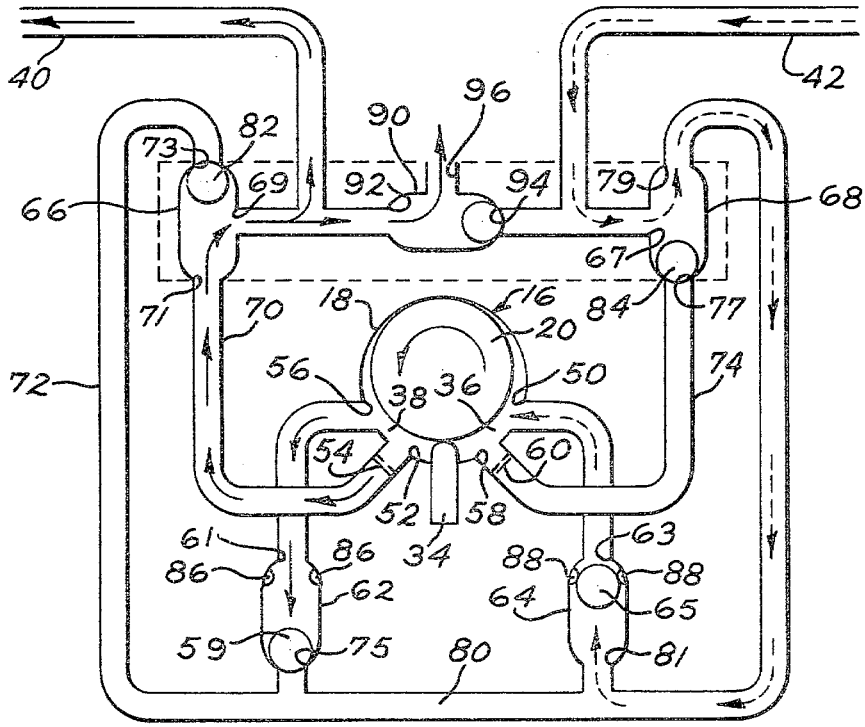
FIG. 4 is a schematic view similar to FIG. 3 showing refrigerant flow in the opposite direction.

In operation in the heating cycle, the rotor 20 is driven by motor 26 in the counter clockwise direction as shown in FIG. 4. Suction gas flows as indicated by the broken line arrow entering conduit 42 from the outdoor heat exchanger 46 functioning as the evaporator. Since the valve 68 is in its normal position with end 77 closed by ball valve 84, the suction gas flows through the open end 79 and conduit 76. Suction pressure flowing through line 76 lifts ball valve 65 and opens the gravity biased check valve 64. Projection 88 insures that suction gas enters side 36 of chamber 16. Rotation of the rotor in the counter clockwise direction compresses the gas in side 38 of chamber 16 and discharges the now high pressure gas through port 52. The discharge pressure being sufficient to open valve 54 and to maintain valve 62 in its closed position shown against action of low pressure suction gas present in line 80. Discharge gas flows as indicated by the solid line arrow and now flows through conduit 70 with enough pressure to force the ball valve member 82 of valve 66 off the normally closed end 71 and high pressure gas flows through unvalved opening 69 of valve 66 and through line 40 to the indoor coil 44 functioning as the system condenser. At the same time closing off end 73 of valve 66 thereby preventing flow into low pressure line 72.

Means are also provided by the present invention to maintain the interior of the casing 12 at high discharge pressure. To this end, a check valve 90 is arranged so as to be responsive to the high pressure discharge gas flowing through either discharge lines 40, 42. One port 92 communicates with unvalved opening 69 of valve 66 intermediate the ends 71 and 73 and the other port 94 communicates with unvalved opening 67 of valve 68 intermediate the ends 77 and 79. Check valve 94 is also provided with an open or vent port 96 that communicates with the interior of the casing 12. In operation in the cooling cycle, high pressure gas exiting opening 67 of valve 68 and flowing through line 42 forces the ball valve member 98 of valve 90 to open port 94 as shown in FIG. 3 and close off port 92 to prevent high pressure gas from passing through to the low side of valve 90 and allowing high pressure gas to flow through port 96 and into the casing. In the heating cycle, high pressure gas exiting opening 69 of valve 66 and flowing through line 40 forces the ball valve member 98 of valve 90 to open port 92 as shown in FIG. 4 and close off port 94 to prevent high pressure gas from passing through to the low side of valve 90, and allowing high pressure gas to flow through port 96 and into the casing. The arrangement of valve 90 provides an effective means of venting high pressure gas into the casing in both the heating and cooling cycle or in either direction of rotation of rotor 20. As with the other check valves shown in the present embodiment, valve 90 may be of any convenient construction that provides the desired directional refrigerant flow.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A reversible hermetically sealed rotary refrigerant compressor comprising:

a hermetic casing containing a high pressure refrigerant gas including a first and second opening;

a compressor unit positioned in said casing; including a cylinder having an annular chamber, spaced under and lower end walls connecting with said cylinder and enclosing said annular chamber, a rotor eccentrically rotatable within said chamber with the peripheral surface of said rotor arranged to move progressively into sealing relation with successive portions of said annular chamber;

a reversible motor in said casing having a shaft thereon extending into said cylinder for driving said rotor;

a radial slot in said cylinder communicating with said chamber;

a blade slidably positioned in said radial slot;

means biasing said blade against said rotor for following said rotor thereby to drive said chamber into interchangeable high and low pressure sides;

a first gas suction port in said cylinder communicating with one side of said chamber;

a first gas discharge port in said cylinder communicating with the other side of said chamber;

a second gas suction port in said cylinder communicating with the other side of said chamber;

a second gas discharge port in said cylinder communicating with said one side of said chamber;

a discharge check valve associated with each of said discharge ports dimensioned to prevent reverse flow of refrigerant into the respective side of said chamber;

a suction check valve associated with each of said suction ports dimensioned to prevent reverse flow of refrigerant from the respective side of said chamber;

first conduit means connecting said first suction port to said one casing opening and said first discharge port to said other casing opening when rotation of said rotor in one direction;

second conduit means connecting said second suction port to said other casing opening and said second discharge port to said one casing opening when rotation of said rotor is in the other direction; and valve means communicating with said first and second conduit means being responsive when high pressure refrigerant gas is flowing through one of said conduit means from its associated discharge port for discharging a portion of said high pressure refrigerant gas therefrom into said casing to maintain the interior of said casing at said high pressure while preventing the flow of high pressure discharge gas from entering the suction port through the other of said conduit means.

2. A reversible hermetically sealed rotary refrigerant compressor recited in claim 1 wherein said first suction port is in said low pressure side of said chamber and said first discharge port is in said high pressure side of said chamber when rotation of said rotor is in said one direction, and said second suction port is in said low pressure side of said chamber and said second discharge port is in said high pressure side of said chamber when rotation of said rotor is in said other direction.

3. A reversible hermetically sealed rotary refrigerant compressor comprising:

a hermetic casing containing a high pressure refrigerant gas including a first and second opening;

a compressor unit positioned in said casing; including a cylinder having an annular chamber, spaced upper and lower end walls connecting with said cylinder and enclosing said annular chamber, a rotor eccentrically rotatable within said chamber with the peripheral surface of said rotor arranged to move progressively into sealing relation with successive portions of said annular chamber;

a reversible motor in said casing having a shaft thereon extending into said cylinder for driving said rotor;

a radial slot in said cylinder communicating with said chamber;

a blade slidably positioned in said radial slot;

means biasing said blade against said rotor for following said rotor thereby to divide said chamber into interchangeable high and low pressure sides;

a first gas suction port in said cylinder communicating with one side of said chamber, a suction check valve associated with said suction port for permitting refrigerant flow into said chamber when said rotor is rotating in one direction and for preventing reverse flow of refrigerant from said chamber when the rotor is rotating in the other direction;

a first gas discharge port in said cylinder communicating with the other side of said chamber, a discharge check valve associated with said discharge port for permitting refrigerant flow from said chamber when said rotor is rotating in said one direction and for preventing reverse flow of refrigerant into said chamber when the rotor is rotating in said other direction;

a second gas suction port in said cylinder communicating with said other side of said chamber, a suction check valve associated with said suction port for permitting refrigerant flow into said chamber when said rotor is rotating in said other durection and for preventing reverse flow of refrigerant with said chamber when the rotor is rotating in said one direction;

a second gas discharge port in said cylinder communicating with the said one side of said chamber, a discharge check valve associated with said suction port for permitting refrigerant flow into said chamber when said rotor is rotating in said other durection and for preventing reverse flow of refrigerant with said chamber when the rotor is rotating in said one direction;

a second gas discharge port in said cylinder communicating with the said one side of said chamber, a discharge check valve associated with said discharge port for permitting refrigerant flow from said chamber when said rotor is rotating in said other direction and for preventing reverse flow of refrigerant into said chamber when the rotor is rotating in said one direction;

first conduit means connecting said first suction port to said one casing opening and said first discharge port to said other casing opening when rotation of said rotor in one direction;

second conduit means connecting said second suction port to said other casing opening and said second discharge port to said one casing opening when rotation of said rotor is in the other direction; and valve means communicating with said first and second conduit means being responsive when high pressure refrigerant gas is flowing through one of said conduit means from its associated discharge port for discharging a portion of said high pressure refrigerant gas therefrom into said casing to maintain the interior of said casing at said high pressure while preventing the flow of high pressure discharge gas from entering the suction port through the other of said conduit means.

4. A reversible hermetically sealed rotary refrigerant compressor recited in claim 3 further comprising a refrigeration system is connected to said compressor including an indoor heat exchanger connected to said first casing opening and an outdoor heat exchanger connected to said second casing opening whereby said outdoor heat exchanger functions as an evaporator during operation of the rotor in said other direction, and said indoor heat exchanger functions as an evaporator during operation of the rotor in said one direction.

5. A reversible hermetically sealed rotary refrigerant compressor comprising:

a hermetic casing containing a high pressure refrigerant gas including a first and second opening;

a compressor unit positioned in said casing; including a cylinder having an annular chamber, spaced upper and lower end walls connecting with said cylinder and enclosing said annular chamber, a rotor eccentrically rotatable within said chamber with the peripheral surface of said rotor arranged to move progressively into sealing relation with successive portions of said annular chamber;

a reversible motor in said casing having a shaft thereon extending into said cylinder for driving said rotor;

a radial slot in said cylinder communicating with said chamber;

a blade slidably positioned in said radial slot;

means biasing said blade against said rotor for following said rotor thereby to divide said chamber into interchangeable high and low pressure sides;

a first gas suction port in said cylinder communicating with one side of said chamber;

a first gas discharge port in said cylinder communicating with the other side of said chamber;

a second gas suction port in said cylinder communicating with the other side of said chamber;

a second gas discharge port in said cylinder communicating with said one side of said chamber;

a discharge check valve associated with each of said discharge ports to prevent reverse flow of refrigerant into the respective side of said chamber;

a suction check valve associated with each of said suction ports to prevent reverse flow of refrigerant from their respective side of said chamber;

first conduit means connecting said first suction port to said one casing opening and said first discharge port to said other casing opening when rotation of said rotor in one direction; and second conduit means connecting said second suction port to said other casing opening and said second discharge port to said one casing opening when rotation of said rotor is in the other direction;

said first and second conduit means comprising a high pressure discharge conduit connecting said second discharge port to said one casing opening;

high pressure discharge conduit means connecting said first discharge port to said other casing opening;

low pressure suction conduit means connecting said second suction port to said one casing opening;

low pressure suction conduit means connecting said first suction port to said other casing opening;

means for permitting refrigerant flow from said one side of said chamber, said second discharge port through said high pressure discharge conduit to said one casing opening when rotation of said rotor is in said one direction and for permitting refrigerant flow from one casing opening through said low pressure suction conduit said first suction port to said one side of said chamber when rotation of said rotor is in said other direction;

means for permitting refrigerant flow from said other side of said chamber, said first discharge port through said high pressure discharge conduit to said other casing opening when rotation of said rotor is in said other direction and for permitting refrigerant flow from said other casing opening through said low pressure suction conduit said second suction port to said other side of said chamber when rotation of said rotor is in said other direction; and valve means communicating with said first and second conduit means being responsive when high pressure refrigerant gas is flowing through one of said conduit means from its associated discharge port for discharging a portion of said high pressure refrigerant gas therefrom into said casing to maintain the interior of said casing at said high pressure while preventing the flow of high pressure discharge gas from entering the suction port through the other of said conduit means.

6. A reversible hermetically sealed rotary refrigerant compressor recited in claim 5 further comprising a refrigeration system is connected to said compressor including an indoor heat exchanger connected to said first casing opening and an outdoor heat exchanger connected to said second casing opening whereby said outdoor heat exchanger functions as an evaporator during operation of the rotor in said other direction, and said indoor heat exchanger functions as an evaporator during operation of the rotor in said one direction.

7. A reversible hermetically sealed rotary refrigerant compressor comprising:

a hermetic casing containing a high pressure refrigerant gas including a first and second opening;

a compressor unit positioned in said casing; including a cylinder having an annular chamber, spaced upper and lower end walls connecting with said cylinder and enclosing said annular chamber, a rotor eccentrically rotatable within said chamber with the peripheral surface of said rotor arranged to move progressively into sealing relation with successive portions of said annular chamber;

a reversible motor in said casing having a shaft thereon extending into said cylinder for driving said rotor;

a radial slot in said cylinder communicating with said chamber;

a blade slidably positioned in said radial slot;

means biasing said blade against said rotor for following said rotor thereby to divide said chamber into interchangeable high and low pressure sides;

a first gas suction port in said cylinder communicating with one side of said chamber, a suction check valve associated with said suction port for permitting refrigerant flow into said chamber when said rotor is rotating in one direction and for preventing reverse flow of refrigerant from said chamber when the rotor is rotating in the other direction;

a first gas discharge port in said cylinder communicating with the other side of said chamber, a discharge check valve associated with said discharge port for permitting refrigerant flow from said chamber when said rotor is rotating in said one direction and for preventing reverse flow of refrigerant into said chamber when the rotor is rotating in said other direction;

a second gas suction port in said cylinder communicating with said other side of said chamber, a suction check valve associated with said suction port for permitting refrigerant flow into said chamber when said rotor is rotating in said other direction and for preventing reverse flow of refrigerant with said chamber when the rotor is rotating in said one direction;

a second gas discharge port in said cylinder communicating with the said one side of said chamber, a discharge check valve associated with said discharge port for permitting refrigerant flow from said chamber when said rotor is rotating in said other direction and for preventing reverse flow of refrigerant into said chamber when the rotor is rotating in said one direction;

first conduit means connecting said first suction port to said one casing opening and said first discharge port to said other casing opening when rotation of said rotor in one direction; and second conduit means connecting said second suction port to said other casing opening and said second discharge port to said one casing opening when rotation of said rotor is in the other direction;

said first and second conduit means comprising a high pressure discharge conduit connecting said second discharge port to said one casing opening;

high pressure discharge conduit means connecting said first discharge port to said other casing opening;

low pressure suction conduit means connecting said second suction port to said one casing opening;

low pressure suction conduit means connecting said first suction port to said other casing opening;

means for permitting refrigerant flow from said one side of said chamber, said second discharge port through said high pressure discharge conduit to said one casing opening when rotation of said rotor is in said one direction and for permitting refrigerant flow from one casing opening through said low pressure suction conduit said first suction port to said one side of said chamber when rotation of said rotor is in said other direction;

means for permitting refrigerant flow from said other side of said chamber, said first discharge port through said high pressure discharge conduit to said other casing opening when rotation of said rotor is in said other direction and for permitting refrigerant flow from said other casing opening through said low pressure suction conduit said second suction port to said other side of said chamber when rotation of said rotor is in said other direction; and valve means communicating with said first and second conduit means being responsive when high pressure refrigerant gas is flowing through one of said conduit means from its associated discharge port for discharging a portion of said high pressure refrigerant gas therefrom into said casing to maintain the interior of said casing at said high pressure while preventing the flow of high pressure discharge gas from entering the suction port through the other of said conduit means.

8. A reversible hermetically sealed rotary refrigerant compressor recited in claim 7 further comprising a refrigeration system is connected to said compressor including an indoor heat exchanger connected to said first casing opening and an outdoor heat exchanger connected to said second casing opening whereby said outdoor heat exchanger functions as an evaporator during operation of the rotor in said other direction, and said indoor heat exchanger functions as an evaporator during operation of the rotor in said one direction.

* * * * *